US007543782B2

(12) United States Patent
Cummins

(10) Patent No.: US 7,543,782 B2
(45) Date of Patent: Jun. 9, 2009

(54) PAINT BRUSH HOLDER CONSISTING OF ONE PART

(76) Inventor: Peter Cummins, 16 Meadow Ct., Daingean, County Offaly (IE)

( * ) Notice: Subject to any disclaimer, the term of this patent is extended or adjusted under 35 U.S.C. 154(b) by 274 days.

(21) Appl. No.: 10/532,449

(22) PCT Filed: Oct. 24, 2002

(86) PCT No.: PCT/IE02/00150

§ 371 (c)(1),
(2), (4) Date: Apr. 22, 2005

(87) PCT Pub. No.: WO2004/041549

PCT Pub. Date: May 21, 2004

(65) Prior Publication Data

US 2005/0269469 A1 Dec. 8, 2005

(51) Int. Cl.
*A46B 3/08* (2006.01)

(52) U.S. Cl. ..... 248/113; 248/112; 248/302

(58) Field of Classification Search ..... 248/112, 248/113, 110, 111, 302, 249, 213.2
See application file for complete search history.

(56) References Cited

U.S. PATENT DOCUMENTS 2,508,707 A 5/1950 Davis
2,578,233 A 12/1951 Entsminger
4,025,206 A 5/1977 Rubin
5,035,386 A * 7/1991 Tucker ..... 248/110
5,476,240 A * 12/1995 McDonough ..... 248/213.2
6,027,081 A 2/2000 Rosenberg
6,494,417 B1 * 12/2002 Gizzi ..... 248/110
6,820,848 B1 * 11/2004 Adam ..... 248/213.2
6,859,973 B1 * 3/2005 Oranday ..... 15/257.01

FOREIGN PATENT DOCUMENTS

DE 8627377 2/1987

OTHER PUBLICATIONS

International Search Report for PCT/IE02/00150 dated Jun. 23, 2003.

* cited by examiner

*Primary Examiner*—J. Allen Shriver
*Assistant Examiner*—Steven Marsh
(74) *Attorney, Agent, or Firm*—Ostrolenk, Faber, Gerb & Soffen, LLP

(57) ABSTRACT

The present paint brush holder is for the purpose of resting a paint brush over a paint container, with the paint brush bristles suspended over the inner portion of the open paint container. The paint brush holder when attached to the rim of a paint container, allows the user to rest the paint brush in the paint brush holder and allows the principle of inertia of the paint brush, acting on two points to create a grip on the paint brush handle. Further points of the paint brush holder restrict lateral movement of the paint brush. The paint brush holder can be used with a variety of types and sizes of paint brush, and can be fitted to a variety of types and sizes of paint container, the paint brush holder being of spring content.

4 Claims, 2 Drawing Sheets

PAINT BRUSH HOLDER CONSISTING OF ONE PART

CROSS REFERENCE TO RELATED APPLICATION

The present application is a 35 U.S.C. § 371 national phase conversion of PCT/IE2002/000150 filed 24 Oct. 2002.

The PCT International Application was published in the English language.

BACKGROUND AND SUMMARY OF THE INVENTION

The present paint brush holder, being of spring content, intends to accommodate the option of resting a variety of types and sizes of paint brush on the paint brush holder while positioned on a paint container of varying type or size, without modifying or attaching any other part or component to the paint brush holder. The paint brush holder attaches to the rim of a paint container for the purpose of holding a paint brush while the paint container is in a stationary upright position with the lid removed, and also for holding the paint brush while carrying the paint container by its handle, with the lid removed, as in the normal process of painting with paint brush and paint container.

DETAILED DESCRIPTION OF THE INVENTION AND DRAWINGS

Figure 1:
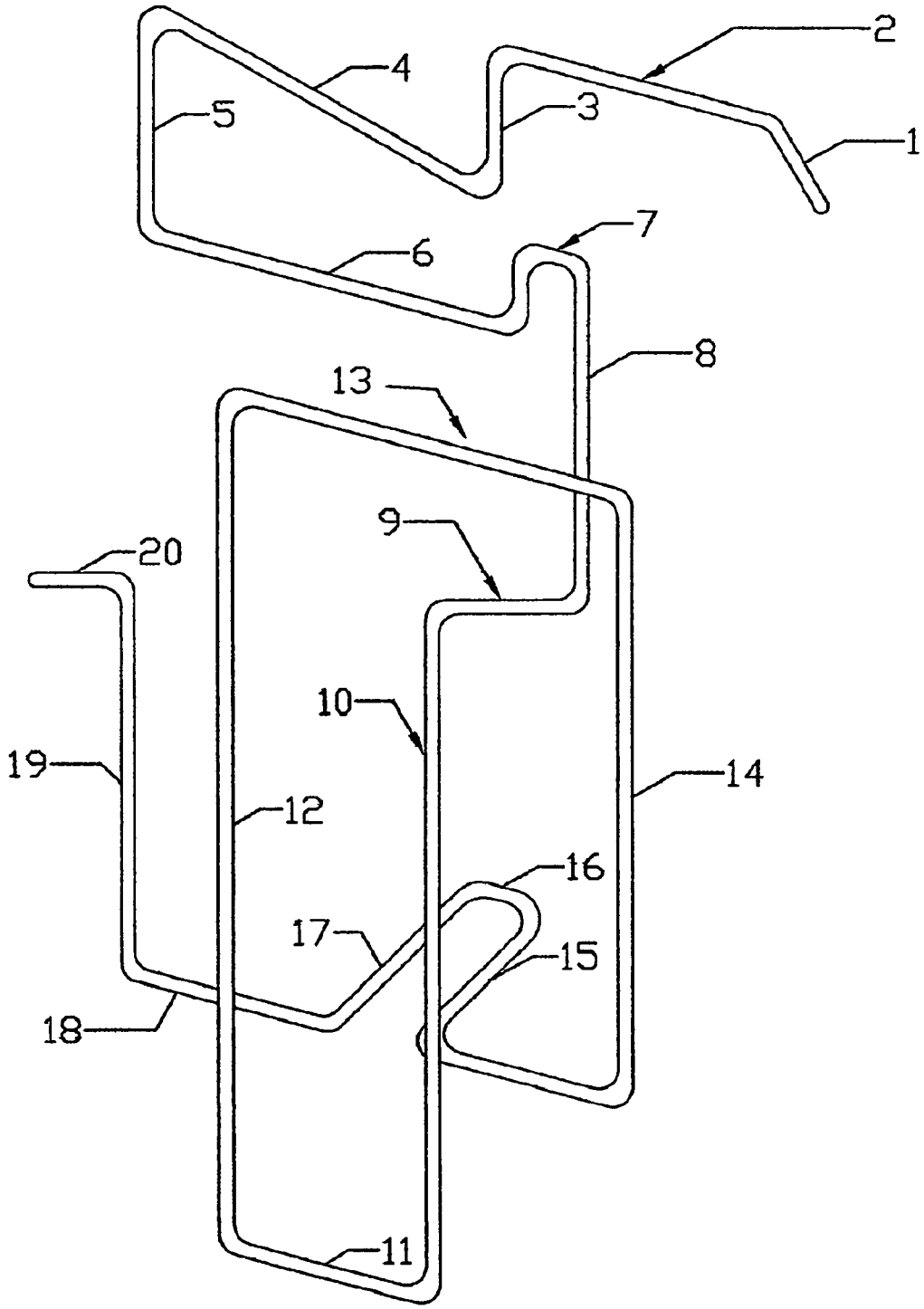
FIG. 1 shows the paint brush holder.

As in accompanying drawings, the paint brush holder is of single part of spring material formed at nineteen positions to attain the desired shape for attachment to the paint container. By holding points 15,16 and 17 with the thumb and finger, point 11 can be placed against the inside rim of the paint container. When points 15, 16 and 17 are pulled towards the outer rim of the paint container, a gap is created that separates points 10, 11 and 12, from points 14,15, 16,17, 18 and 19, allowing the paint brush holder to be moved downwards on the paint container rim, and rested on the top edge of the paint container rim at points 9 and 20. When the grip is released by thumb and finger from points 15, 16 and 17, the spring content of the material creates a grip on the paint container rim, closing the gap that separates points 10,11 and 12 from points 14,15, 16,17, 18 and 19.

When the paint brush holder is in operational position on the rim of the paint container, point 6 would be closer to the rim of the paint container and lower than point 2. This creates a forward movement of the paint brush, causing a part of the paint brush handle further from the paint brush bristles to rest under point 2, and causing a part of the paint brush handle closer to the paint brush bristles to rest over and down on point 6. Acting on the inertia (forward movement) of the paint brush, and using this principle to create a grip on the paint brush handle, this suspends the paint brush bristles over the inner portion of the paint container. In addition, points 1, 3, 5 and 7 inhibit lateral movement of the paint brush.

Generally the present invention comprises a paint brush holder, formed of one continuous part from spring material, for allowing a user to position and to hold a paint brush on the rim of a paint container. With reference to the drawings and particularly FIG. 1, the various sections and bends of the one piece paint brush holder are shown. Groups of the sections and bends form holding elements for attachment to a paint container and for holding of a paint brush and for integrally connecting the two (since it is a one piece unit).

Figure 2:
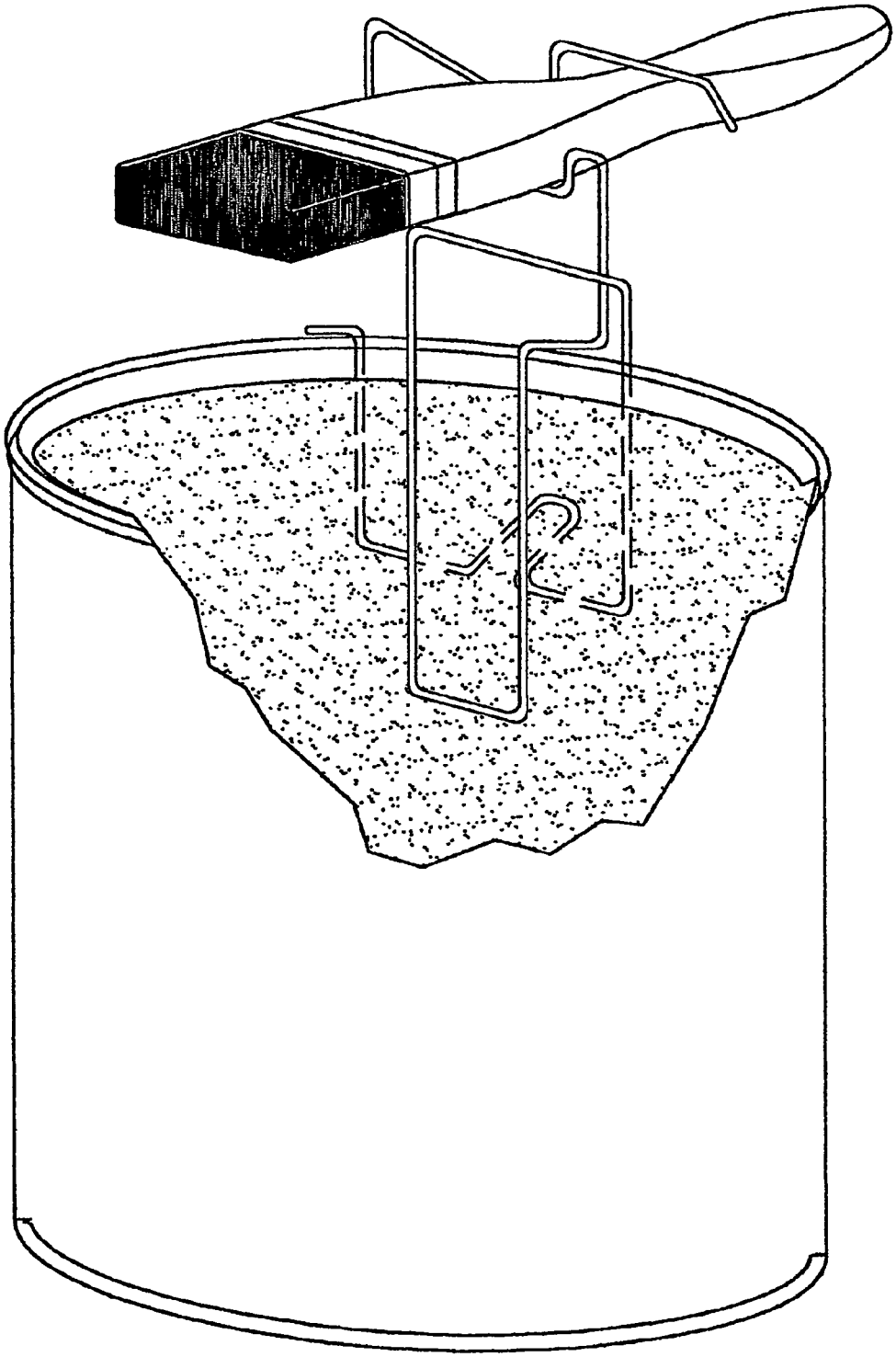
FIG. 2 shows a view of the paint brush holder in use.

The paint brush holder comprises a paint brush receiving section shown as being comprised of connected but separately identifiable elements 1, 2, 3, 4, 5, 6 and 7, with each (except for end element 1) having an initial lead-in bend from the prior element and terminal lead-out bend to the next element (element 1 has only a terminal lead-out bend). The paint brush receiving section formed from elements 1-7, receives and holds a paint brush as shown in FIG. 2. It includes four limbs at 1, 3, 5 and between 6 and 7 for inhibiting lateral movements of the brush.

In accordance with the present invention and as shown in FIG. 1, the paint brush receiving section is integrally connected to a container engaging section via connecting segments 8 and 9. The container engaging section is comprised of connected but separately identifiable elements 9, 10, 11, 12, 13, 14, 15, 16, 17, 18, 19 and 20 with each (except for end element 20) having an initial lead-in bend from the prior element and terminal lead-out bend to the next element (element 20 has only a terminal lead-in bend). The container engaging section includes a first part with a generally U-shaped profile comprised of elements 10, 11 and 12 and lead in element 9 for biasing against the inside wall of the paint container as shown in FIG. 2 and a second part of the container engaging section is comprised of elements, 14, 15, 16, 17, 18, and 19 (with lead out element 20) for biasing against the outside of the paint container (as shown in partial phantom in FIG. 2). A portion of the continuous material forms a transverse limb 13 which is directly integral with and connects the two container engaging section parts. Limb 13 connects first and second parts of the container engaging section which are in separate planes in order to engage opposite sides of a wall of a paint container. Limb 13 accordingly extends transversely between the planes and is physically located above the two parts between the paint brush receiving section and the container engaging section.

The first part (comprised of elements 10, 11, and 12) together with a transverse limb 13 of the paint brush holder, define a generally rectangular shaped appearing section part. The first section part, as seen in FIG. 1 is narrower and longer than the profile of the second part. As a result, in use, when the paint brush holder is attached to a paint container, as seen in FIG. 2; the paint brush holder grips the container with the first part extending downwardly along the inside wall of the container and the paint brush holder allows placement of the paint brush in a position where bristles of the paint brush are positioned to be within the rim of the paint container.

In structural configuration as seen in FIG. 1, the paint brush receiving section, comprised of elements 1-7 has two parallel arms 2 and 6 with one arm 6 being lower than other arm 2, and the paint brush receiving section acts on the inertia of the paint brush such that when the paint brush is placed in the paint brush holder as shown in FIG. 2 and supported between the arms 2 and 6, the bristles of the paint brush are kept over the container so that any dripping from a paint brush received in the holder is directed into the container.

End element 20 of second section part is s bent toward the first section part whereby element 20 and element 9 function as two container rim engaging parts for resting on the rim of the paint container.

Elements 15, 16 and 17 form a lever section extending out of the plane of the second part, which grips the outside wall of the container. The lever section extends away from the container and is formed to allow the paint brush holder to be gripped by the user's thumb and finger whereby when the first part is placed on the inside of the container and the lever section is held by a user's thumb and finger and is pulled away from the container, the paint brush holder can be pushed downwards onto the container so as to locate the first part along the inside wall of the container and the second part along the outside wall of the container such that when the lever portion is released, the paint brush holder grips the container.

When a paint brush as shown in FIG. 2 is held by the paint brush receiving section, it is securely resting on element 6 and is peripherally secured at four points by segments 3, 4 and 5, and the bend leading into element 7. This securing inhibits the lateral movement of the paint brush thereby allowing the user to carry the container by its handle, as is necessary in the normal process of painting with paint container and paint brush.

The invention claimed is:

1. A paint brush holder, formed of one continuous part from spring material, for allowing a user to position and to hold a paint brush on the rim of a paint container, the paint brush holder comprising:

a paint brush receiving section for receiving and holding a paint brush, the paint brush receiving section has two arms in parallel planes which are spaced apart from each other, the arms being offset from each other and one arm being lower than other arm, and the paint brush receiving section acts on the inertia of the paint brush such that, in use, with a paint brush placed in the paint brush holder, the bristles of the paint brush are kept over the container so that any dripping from a paint brush received in the holder is directed into the container, a container engaging section including a first member for biasing against the inside wall of the paint container and a second member for biasing against the outside of the paint container; the first member having a generally U-shaped profile which is narrower and longer than the profile of the second member whereby, in use, when the paint brush holder is attached to a paint container, the paint brush holder grips the container with the first member extending downwardly along the inside wall of the container paint container.

2. A paint brush holder as claimed in claim 1 wherein the container engaging section includes two container rim engaging parts for resting on the rim of the paint container.

3. A paint brush holder as claimed in claim 1 wherein the second member of the container engaging section has a lever section formed to allow the paint brush holder to be gripped by the user's thumb and finger whereby when the first member is placed on the inside of the container and the lever section is held by a user's thumb and finger and is pulled away from the container, the paint brush holder can be pushed downwards onto the container so as to locate the first member along the inside wall of the container and to locate the second member along the outside wall of the container such that when the lever portion is released, the paint brush holder grips said container.

4. A paint brush holder as claimed in claim 1, wherein the paint brush receiving section of the paint brush holder includes four limbs for inhibiting lateral movement of a paint brush in the paint brush holder, thereby allowing the user to carry the container by a handle of the container.

* * * * *